US006311753B1

(12) United States Patent
Kawada

(10) Patent No.: US 6,311,753 B1
(45) Date of Patent: Nov. 6, 2001

(54) LABEL PRINTING-AND-APPLYING DEVICE

(75) Inventor: Toshikazu Kawada, Tokyo (JP)

(73) Assignee: Towa Seiko Co., Ltd., Tokyo (JP)

( * ) Notice: Subject to any disclaimer, the term of this patent is extended or adjusted under 35 U.S.C. 154(b) by 0 days.

(21) Appl. No.: 09/334,559

(22) Filed: Jun. 21, 1999

(30) Foreign Application Priority Data

Jul. 1, 1998 (JP) ..... 10-186655

(51) Int. Cl.[7] ..... B65C 11/02

(52) U.S. Cl. ..... 156/384; 156/541; 156/577; 156/579

(58) Field of Search ..... 156/384, 540, 156/541, 577, 579, 387, 542; 101/288

(56) References Cited

U.S. PATENT DOCUMENTS 2,656,063 * 10/1953 Kafka ..... 156/384
4,156,627 * 5/1979 Hamisch, Jr. ..... 156/384
4,233,900 * 11/1980 Sato ..... 101/288
4,369,085 * 1/1983 Hermann ..... 156/384
4,419,171 * 12/1983 Becker et al. ..... 156/384
4,491,497 * 1/1985 Kistner et al. ..... 156/384
4,853,068 * 8/1989 Becker ..... 156/384
5,655,450 * 8/1997 Hermann ..... 101/288
5,900,108 * 5/1999 Sekine ..... 156/384

* cited by examiner

*Primary Examiner*—Richard Crispino
*Assistant Examiner*—Sue H. Purvis
(74) *Attorney, Agent, or Firm*—Arent Fox Kintner Plotkin & Kahn

(57) ABSTRACT

Disclosed is a label printing-and-applying device including a label feeding mechanism and an impression unit so operatively connected that a roll of blank label bearing tape is unrolled intermittently every time the opposite grips of the device are squeezed to allow the impression unit to print a desired letter or pattern on blank labels one after another subsequent to peeling-off of such blank labels from the tape, and that the so printed labels are applied to objects. It further includes a printing pressure controlling mechanism for controlling the impression pressure in printing a selected letter or pattern on blank labels.

3 Claims, 5 Drawing Sheets

LABEL PRINTING-AND-APPLYING DEVICE

BACKGROUND OF THE INVENTION

1. Field of the Invention

The present invention relates to a label printing-and-applying device which can print a desired alphanumeric pattern on blank labels every time they are peeled off from an elongated tape fed from the roll of tape so that the labels thus printed are applied to objects such as articles of commerce.

2. Description of Related Art

A conventional label printing-and-applying device has an impression unit operatively connected to its handles. When the handles are squeezed with hand, the impression unit is made to descend and print a desired letter or mark on a selected label, and the label thus printed is removed from the blank label bearing tape to be applied to an article of commerce.

Such a conventional label printing-and-applying device, however, cannot provide high quality of impression; the printing quality depends on the squeezing strength of the handles in operation, and the length of time for printing, but these factors are variable.

SUMMARY OF THE INVENTION

One object of the present invention is to provide a label printing-and-applying device which permits the impression unit to work in one and same controlled condition, independent from different persons using the device, specifically by applying a predetermined pressure for a controlled length of time.

To attain this object a label printing-and-applying device comprising a label feeding mechanism and an impression unit so operatively connected that a roll of blank label bearing tape is unrolled intermittently every time the handles of the device are squeezed to allow the impression unit to print a desired letter or pattern on blank labels one after another subsequent to the peeling-off of such blank labels from the tape, and that the so printed labels are applied to objects, is improved according to the present invention in that it further comprises a printing pressure controlling mechanism for controlling the pressure to be applied to blank labels by the impression unit for printing the desired letter or pattern thereon.

With this arrangement a controlled impression pressure can be applied to the typeface of the impression unit regardless of which persons may use the label printing-and-applying device, and the operability of the device is so good that nobody may feel fatigued even though the device is used for an elongated time of period.

The printing pressure controlling mechanism may comprise: first and second driving arms responsive to the squeezing of the handles of the device for turning simultaneously; a holding arm fixed to the impression unit, said holding arm being responsive to the turning of the second driving arm for turning; and a rotary engagement lever spring-biased in the counter direction relative to the turning direction of the first driving arm, one end of the rotary engagement lever being detachably engaged with the free end of the first driving arm; the second driving arm having an elongated slot formed in its free end, and the holding arm having an upright stud pin movably fitted in the elongated slot of the second driving arm, said upright stud pin being spring-biased toward the second driving arm all the time, thereby permitting the impression unit to be applied to a selected blank label under a predetermined pressure while the second driving arm turns an angular distance equal to the elongated slot subsequent to the termination of the descending of the impression unit.

The printing pressure controlling mechanism is of simple structure, still assuring that the pressure to be applied to the typeface of the impression unit is controlled as desired.

The second driving arm may have an adjustment screw to be driven or withdrawn in the elongated slot for adjusting the effective length of the elongated slot.

The label printing-and-applying device may further comprise a nail-like feeler-and-label pusher rotatably fixed to one side plate of the housing at a level somewhat higher than the place in which blank labels are peeled off from the tape, the nail-like feeler-and-label pusher being spring-biased to lightly touch the tape, and an anti-rotation rod for preventing the nail-like feeler-and-label pusher from reversing in rotation.

Other objects and advantages of the present invention will be understood from the following description of a label printing-and-applying device according to one embodiment of the present invention, which is shown in accompanying drawings.

DESCRIPTION OF THE PREFERRED EMBODIMENTS

Figure 1:
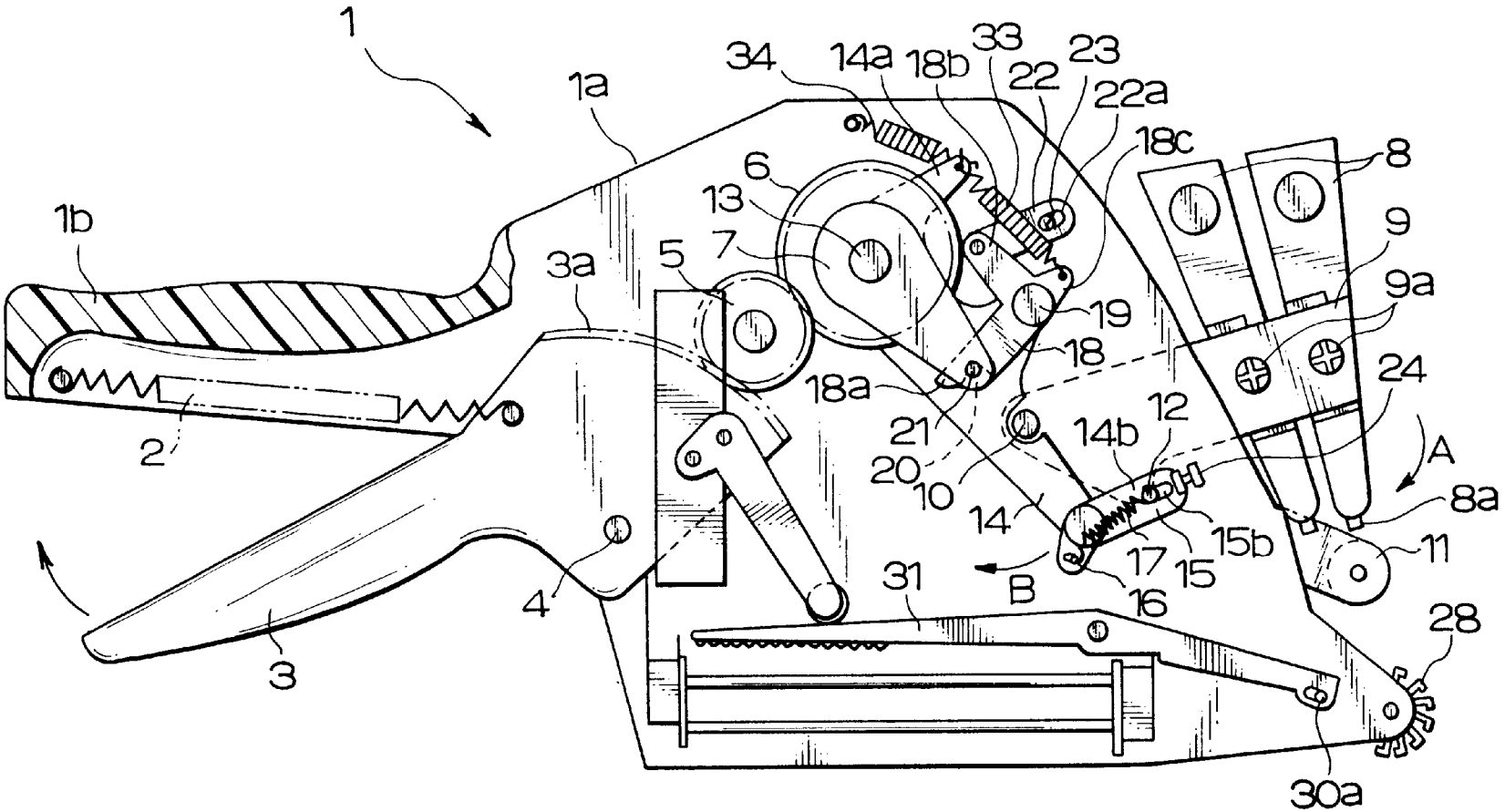
FIG. 1 shows the structure of a label printing-and-applying device according to the present invention.
Figure 2:
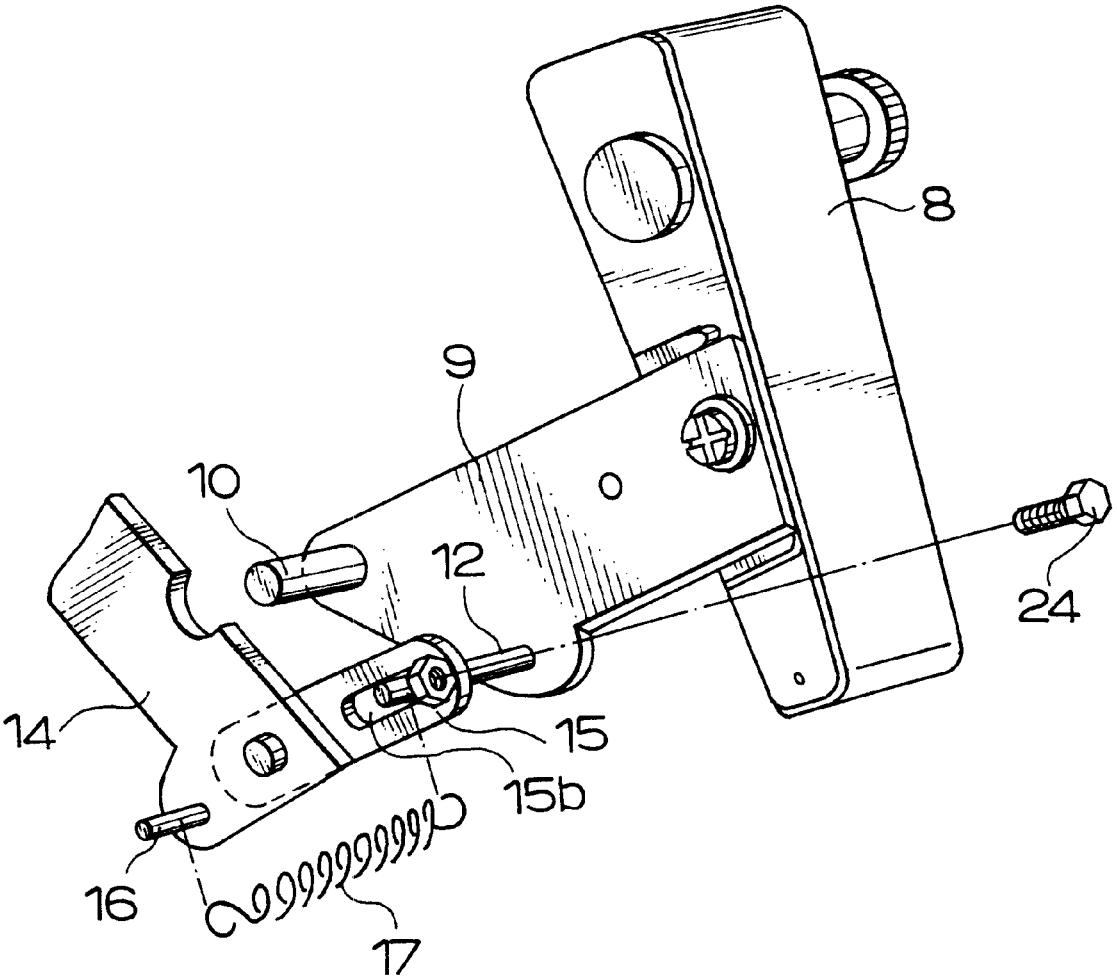
FIG. 2 is an enlarged view of some selected parts of the label printing-and-applying device, showing how the second driving arm is operatively connected to the holding arm of the impression unit.

Referring to the accompanying drawings, a label printing-and-applying device 1 according to the present invention includes a housing having a stationary handle 1*b* integrally connected to one side plate 1*a* and a rotary handle 3 rotatable about a pivot axis 4 and spring-biased toward the opening position by a coiled spring 2, which is stretched between the stationary and rotary handles 1*b* and 3.

The rotary handle 3 has a sector 3*a* formed on the side opposite to the free end of the rotary handle 3, and the sector 3*a* engage with an intermediate toothed wheel 5. The toothed wheel 5 has a radius smaller than that of the sector 3*a*, and accordingly its angular speed is higher than that of the sector 3*a* when turning about the pivot axle 4. The intermediate toothed wheel 5 meshes with a toothed wheel 6, which is fixed to a center axle 13. A first driving arm 7 is rotatably fixed to the axle 13, so that the first driving arm 7 may turn together with the toothed wheel 6 as a whole. Also, a second driving arm 14 is fixed to the center axle 13 to permit it to turn clockwise as indicated by arrow B when the rotary handle 3 is moved toward the stationary handle 1*b*.

An impression unit 8 is fixed to a holding arm 9 with screws 9*a*, and the holding arm is pivoted about a stud pin 10, which stands upright f rom the side plate 1*a* of the housing. When the holding arm 9 turns clockwise about the stud pin 10 as indicated by arrow A, the impression unit 8 descends to print a desired letter or mark on a selected blank label. The impression unit 8 touches with an inking roll 11 to make its typeface 8*a* wet with ink on the way to the blank label.

A T"-shaped engagement lever 18 is fixed to the second driving arm 14 to rotate about a pivot axle 19. The arm 18*a* of the T"-shaped engagement lever 18 has an engagement recess 20 formed on one end, and a coiled spring 33 is stretched between the other end 18*c* of the arm 18*a* and a selected place of the side plate 1*a* of the housing, so that the engagement lever 18 may be spring-biased to rotate counter-clockwise. The first driving arm 7 has a driving stud 21 upright from its free end to be caught by the engagement recess 20. The second driving arm 14 has a radial elongation 14*a* projecting from its pivotal end, and the radial elongation 14*a* is connected to a selected place on the side plate 1*a* of the housing by a coiled spring 34 so that the second driving arm 14 may be spring-biased to rotate counter-clockwise.

The trunk 18*b* of the T"-shaped engagement lever 18 is connected to one end of an actuating rod 22 with a pin. The actuating rod 22 has an elongated hole 22*a* made on the other end, and a stud pin 23 standing upright from the side plate 1*a* of the housing is movably inserted in the elongated hole 22*a*.

With the arrangement as described so far, the second driving arm 14 can rotate about the center axle 13 along with the first driving arm 7 clockwise as indicated by arrow B so far as the driving stud 21 is caught by the engagement recess 20 of the T"-shaped engagement lever 18, which is rotatably fixed to the second driving arm 14.

The second driving arm 14 has a joint plate 15 rotatably fixed to its free end, and the joint plate 15 has an elongated hole 15*b* in its free end. The holding arm 9 has a stud pin 12 standing upright from its lower corner, and the stud pin 12 is movably inserted in the elongated hole 15*b* of the joint plate 15, and is pulled to one end of the elongated hole 15*b* by a coiled spring 17, which is stretched between the stud pin 12 and a counter stud pin 16, which stands upright from the free end of the second driving arm 14. Thus, the stud pin 12 is spring-biased to be pushed against the one end of the elongated hole 15*b* all the time. An adjustment screw 24 is so attached to the other end of the elongated hole 15*b* that the adjustment screw 24 may invade into or withdraw from the elongated hole 15*b* by rotating clockwise or counter clockwise, thus adjusting the effective length of the elongated hole 15*b*.

With the arrangement as described above the stud pin 12 of the holding arm 9 is driven in response to clockwise rotation of the second driving arm 14 to make the holding arm 9 to turn about its pivot axle 10 clockwise as indicated by arrow A, thus making the impression unit 8 to descend and print a desired letter or mark on a selected blank label.

Figure 5:
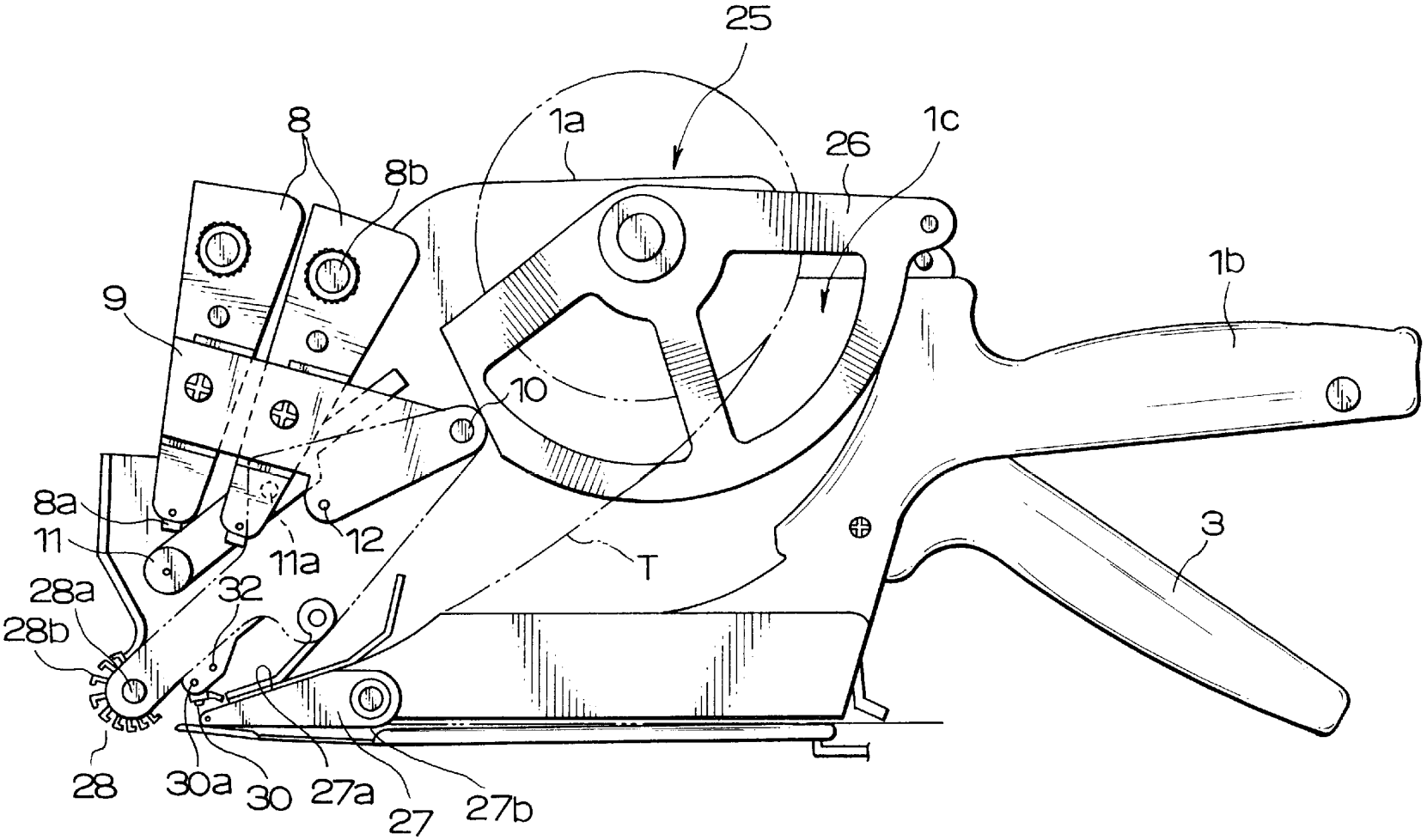
FIG. 5 shows the structure of the device as seen from the side opposite to FIG. 1.

FIG. 5 shows the label printing-and-applying device 1 as viewed from the opposite side of FIG. 1. The opposite side plate 1*a* of the housing has a recess 1*c* formed for accommodating a roll of tapes, and a retainer sector 26 is detachably attached to the tape storing place 25 of the housing, permitting the roll of tape to be held rotatably.

The label printing-and-applying device 1 has a label feeding mechanism installed therein. The label feeding mechanism can be put in operation by squeezing the handles 1*b* and 3, coordinating with the impression unit in unison. Specifically the feeding of blank labels starts at the same time as the operation of the impression unit is completed. A peeling guide member 27 is placed on the opposite side of the stationary handle 1*b*. It comprises a first inner guide surface 27*a* and a second outer guide surface 27*b*, and these guide surfaces converge to an acute angle for smoothly guiding the tape therearound.

A pressing roll 28 for pressing a selected label against a selected object is rotatably supported by an axle 28*a*, and it has a plurality of resilient radial pieces 28*b* projecting from its outer circumference. Also, a guide plate 29 is attached to the peeling guide member 27 for preventing a selected label from floating apart.

A label sensing-and-pushing nail 30 is rotatably pivoted with its free end spring-biased to touch lightly with a selected tape in position. An anti-rotation rod 32 is positioned at a level somewhat higher than the label sensing-and-pushing nail 30 to prevent the nail 30 from reversing in rotation.

When the handles 1*b* and 3 are open, the nail 30 is put in contact with the leading edge of a selected blank label, and when the tape is fed in response to the closing of the handles 1*b* and 3, the nail 30 is caught by the leading edge of the blank label to be tilted, and then it is subjected to a counter force from the first guide surface 27*a*, thereby causing an associated adjustment lever 31 to make an angular displacement to put an angular block in a predetermined position.

The manner in which the label printing-and-applying device works is described below. Again referring to FIG. 5, the tape T is moved forward between the first guide surface 27*a* of the peeling guide member 27 and the guide plate 29 and between the first guide surface 27*a* and the nail 30 in response to the closing of the opposite handles 1*b* and 3. The squeezing of these handles causes the sector 3*a* to rotate the intermediate toothed-wheel 5, and the turning of the intermediate toothed-wheel 5 causes the turning of the subsequent toothed wheel 6 as described earlier (see FIG. 1).

Figure 3:
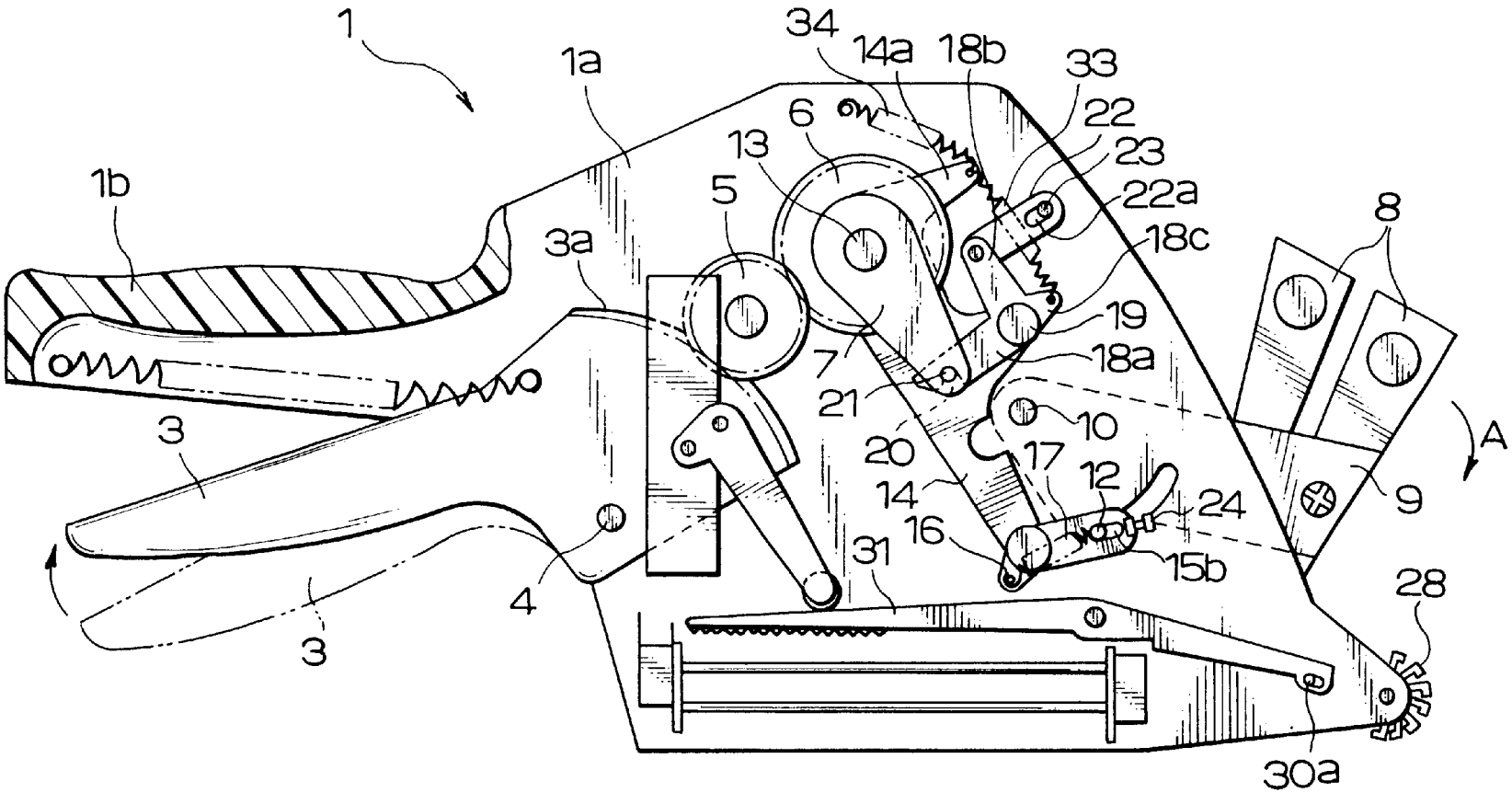
FIG. 3 is similar to FIG. 1, but showing the position in which the device prints a desired letter or pattern on a selected blank label.

Then, the first driving arm 7 turns clockwise, and simultaneously the second driving arm 14 turns clockwise because the first and second driving arms 7 and 14 are jointed with the engagement lever 18. The clockwise rotation of the second driving arm 14 makes the holding arm 9 to turn clockwise about its pivot axle 10 through the agency of the rotary stud pin 12, which is movably fitted in the elongated hole 15*b* of the joint plate 15, and is pushed against the one end of the elongated hole 15*b*. Thus, the holding arm 9 rotates clockwise as indicated by arrow A in FIG. 3 to allow the impression unit 8 to press its typeface 8*a* on a selected blank label. Then, the rotary stud pin 12 remains to be pushed against the left end of the elongated hole 15*b* of the joint plate 15 in FIG. 3.

Figure 4:
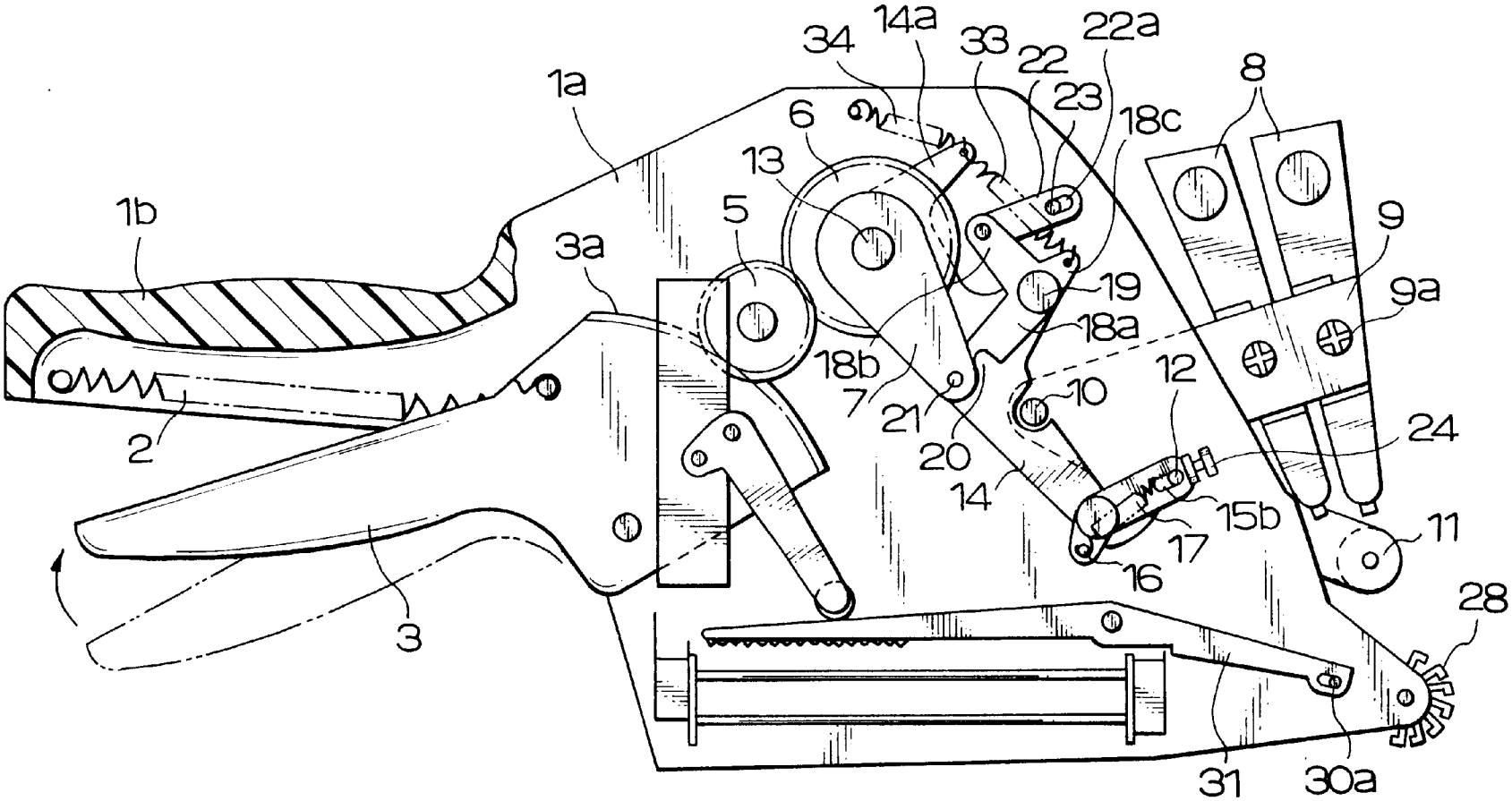
FIG. 4 is a similar view, but showing the position in which the device is reset.

Further squeezing of the stationary and movable handles 1*b* and 3 makes the second driving arm 14 to rotate clockwise by an angular distance equal to the length of the elongated hole 15*b*. The impression unit 8 holds its typeface 8 on the label with a predetermined pressure applied thereto until the rotary stud pin 12 has come to contact the other end of the elongated hole 15*b* of the joint plate 15. Then, the driving stud pin 21 of the first driving arm 7 departs from the engagement recess 20 of the arm 18*a* of the engagement lever 18, and at the same time, the engagement lever 18 is allowed to return to its initial position under the influence of the coiled springs 33 and 34 as seen from FIG. 4.

As described above, when the rotary stud pin 12 comes to contact the other end of the elongated hole 15*b*, the turning of the second driving arm 14 stops, and then, the actuating plate 22 permits the engagement lever 18 to depart from the jointing position in which the first and second driving arms 7 and 14 are jointed together. The length of time for which the impression unit 8 presses its typeface on the label is equal to the length of time for which the rotary stud pin 12 moves in the elongated hole 15*b*, allowing the impression unit 8 to apply a predetermined pressure to the label all this while. Thus, the impression unit is assured to permit application of a predetermined pressure for a predetermined length of time sufficient to give the label a clear impression of same quality.

Also, it should be noted that the length of time for impression can be controlled by rotating the adjustment screw 24 clockwise or counter clockwise, thereby adjusting the amount of invasion of the screw in the elongated hole 15*b* to adjust the remaining length of the elongated hole 15*b* accordingly.

The inking roll 11 is positioned below the impression unit 8 to descend and rotate counter clockwise about its pivot axle 11*a* after touching with the descending impression unit 8, thereby inking the typeface 8*a* of the impression unit 8. The pivot center of the rotary inking roll 11 is so apart from the pivot center of the impression unit 8 that the impression unit 8 follows the trace apart from that of the rotary inking roll 11 to reach the label for impression. After completing the required impression the movable handle 3 is allowed to move apart from the stationary handle 1*b*, and the rotary inking roll 11 returns to its original position under the influence of springs (not shown).

Likewise, the impression unit 8 is allowed to return to its initial position under the influence of the springs 33 and 34. Different typefaces can be selectively used by turning an associated rotary thumb piece 8*b*.

Further squeezing of the handles 3 and 1*b* drives the printed label forward after removing from the tape T at the acute edge of the peeling guide 27, allowing the printed label with its application side down to stay at the pressing roll 28. Then, the printed label is applied to a selected object.

While blank labels are fed sequentially by squeezing the handles 3 and 1*b*, the sensing-and-pushing nail 30 is lowered to catch the leading edge of the subsequent blank label, and then, the nail 30 rotates about its pivot axle 30*a* to be raised, preventing further displacement of the movable handle 3 toward the stationary handle 1*b* by actuating the associated control lever 31. The reversal rotation of the nail 30 is prevented by the anti-rotation rod 32. The releasing of the handles put the label printing-and-applying device 1 in the initial condition to stand by for the sequential label printing-and-applying operation.

What is claimed is:

1. A label printing-and-applying device, comprising:

a label feeding mechanism;

an impression unit operatively connected that a roll of blank label bearing tape is unrolled intermittently every time handles of the device are squeezed to allow the impression unit to print a desired letter or pattern on blank labels one after another subsequent to peeling-off of such blank labels from the tape, and that the so printed labels are applied to objects; and a printing pressure controlling mechanism for controlling the pressure to be applied to blank labels by the impression unit for printing the desired letter or pattern thereon, said printing pressure controlling mechanism comprises:

first and second driving arms pivotable to turn about a common axis and responsive to the squeezing of the handles of the device for turning simultaneously;

a holding arm fixed to the impression unit, said holding arm being responsive to the turning of the second driving arm for turning; and a rotary engagement lever spring-biased in the counter direction relative to the turning direction of the first driving arm, one end of the rotary engagement lever being detachably engaged with the free end of the first driving arm;

the second driving arm having an elongated slot formed in its free end, and the holding arm having an upright stud pin movably fitted in the elongated slot of the second driving arm, said upright stud pin being spring-biased toward the second driving arm all the time, thereby permitting the impression unit to be applied to a selected blank label under a predetermined pressure while the second driving arm turns an angular distance equal to the elongated slot subsequent to the termination of the descending of the impression unit.

2. A label printing-and-applying device according to claim 1 wherein the second driving arm includes a joint plate rotatably fixed at the free end of the second driving arm and defining the elongated slot and an adjustment screw operably connected to the joint plate to be driven or withdrawn in the elongated slot for adjusting the effective length of the elongated slot.

3. A label printing-and-applying device according to claim 1 or 2 further comprising a label sensing-and-pushing nail rotatably fixed to one side wall of the housing at a level somewhat higher than the place in which blank labels are peeled off from the tape, the label sensing-and-pushing nail being spring-biased to lightly touch the tape, and an anti-rotation rod for preventing the label sensing-and-pushing nail from reversing in rotation.

* * * * *